United States Patent [19]

Dziobek et al.

[11] Patent Number: 4,877,423

[45] Date of Patent: Oct. 31, 1989

[54] METHOD AND DEVICE FOR COOLING FLUE DUST

[75] Inventors: Frank Dziobek; Horst Möllenhoff, both of Mülheim, Fed. Rep. of Germany

[73] Assignee: Deutsche Babcock Werke Aktiengesellschaft, Oberhausen, Fed. Rep. of Germany

[21] Appl. No.: 257,992

[22] Filed: Oct. 14, 1988

[30] Foreign Application Priority Data

Oct. 28, 1987 [DE] Fed. Rep. of Germany ..... 3736521

[51] Int. Cl.[4] ..... B01D 53/24

[52] U.S. Cl. ..... 55/27; 55/80; 55/269; 55/345; 55/459.1

[58] Field of Search ..... 55/1, 27, 80, 267–269, 55/435, 459.1

[56] References Cited

U.S. PATENT DOCUMENTS

| | | | |
|---|---|---|---|
| 2,076,235 | 4/1937 | Hayes et al. | 55/27 |
| 2,675,889 | 4/1954 | Frey | 55/27 |
| 2,802,280 | 8/1957 | Sylvest | 55/267 X |
| 2,973,057 | 2/1961 | Yellott et al. | 55/1 X |
| 3,592,630 | 7/1971 | Willett | 55/267 X |
| 4,130,632 | 12/1978 | Braunsperger et al. | 55/80 X |
| 4,516,989 | 5/1985 | Mink et al. | 55/1 X |
| 4,543,110 | 9/1985 | Engelhardt et al. | 55/27 |

FOREIGN PATENT DOCUMENTS

| | | | |
|---|---|---|---|
| 3124483 | 1/1983 | Fed. Rep. of Germany | 55/267 |
| 61-238316 | 10/1986 | Japan | 55/80 |
| 8101446 | 11/1981 | Netherlands | 55/1 |
| 445450 | 12/1974 | U.S.S.R. | 55/80 |

OTHER PUBLICATIONS

VGB Kraftwerks-Technik 63 (1983), 422–27.

*Primary Examiner*—Robert Spitzer
*Attorney, Agent, or Firm*—Max Fogiel

[57] ABSTRACT

Flue dust precipitated from the compressed gas from a fluidized-bed combustion chamber is conveyed by flue gas to an air-lock system while simultaneously being cooled to above the water and acid dew point of the flue gas. As it enters the air-lock system, the dust is separated from the flue gas and, once it has left the air-lock system, the dust is conveyed by air while simultaneously being cooled to a final temperature at which it can be removed.

4 Claims, 1 Drawing Sheet

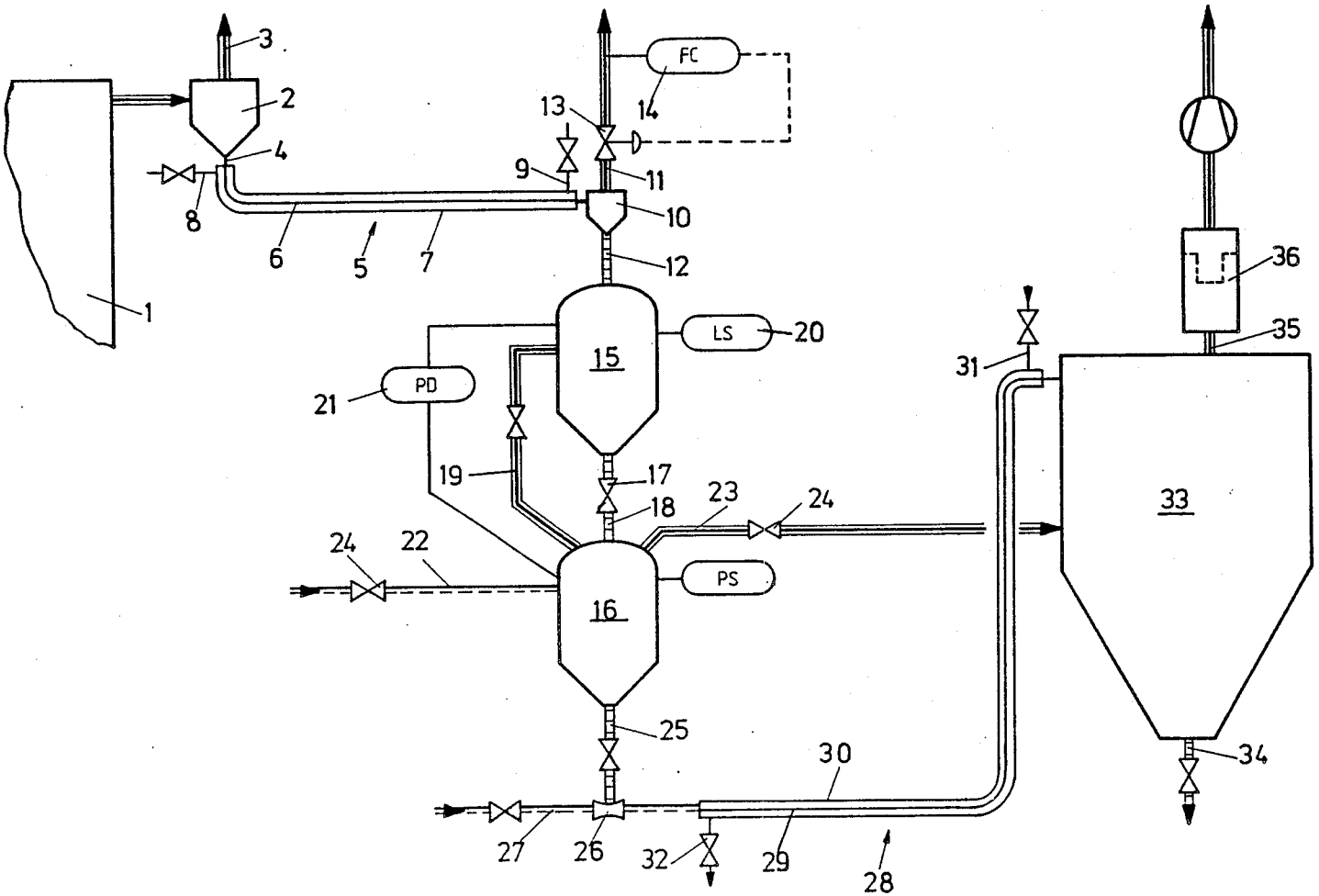
FC
LS
PS
PD

METHOD AND DEVICE FOR COOLING FLUE DUST

BACKGROUND OF THE INVENTION

The flue dust in a known conveyor and cooler (VGB Kraftwerkstechnik 63 [1983], 422–27) is conveyed by compressed air to a system of air locks while simultaneously being cooled to the desired final temperature. Since the temperature of the dust is approximately 850° C., the injectors that the conveying air is supplied through are subject to severe wear that leads to premature failure of those sections of the plant.

Eliminating a system of air locks consisting of two tanks and orienting the cooler pipes in such a way that the direction of flow of the mixture of dust and gas is repeatedly abruptly altered, generating pressure reductions as the result of sequential flection losses is also known (EP Pat. No. 0 108 505). The pipes in a flue-dust conveyor and cooler of this type must be precisely bent in order to prevent erosion. Furthermore, the dust can only be cooled to 150° to 200° C. because, if the temperature drops below the dew point, deposits will form on the inner surface of the pipes and impede conveyance of the dust. The resulting final temperature does not allow unobjectionable removal of the dust.

SUMMARY OF THE INVENTION

The object of the invention is to improve the known flue-dust conveyor and cooler and prevent erosion deriving from the dust, corrosion deriving from the carrier gas, and clogging of the line as the result of temperatures below the dew point. Cooling occurs in accordance with the invention in two stages, with the system of air locks that decreases the pressure interposed between the cooling stages. No pressure-reducing and hence erosion-sensitive components have to be built into the cooler's system of pipes. The erosion-sensitive injectors can also be eliminated from the hot section because flue gas is employed as a carrier in the initial cooling stage. To prevent the pipes from corroding and becoming clogged up as the result of precipitating acid or water, the final temperature of the dust at the end of the initial cooling stage is maintained above the dew point of the flue gas. Air is employed as a carrier in the second cooling stage while the gas is being cooled to a final temperature that will allow unobjectionable removal because the air temperature will not drop below the dew point. Since the temperature of the flue dust decreases considerably before it enters the second cooling stage, the erosion problem must be controlled inside the injector that is needed to supply the conveying air.

The drawing illustrates one embodiment of the invention, which will now be specified.

BRIEF DESCRIPTION OF THE DRAWINGS

A flow chart illustrating how the flue dust is cooled and conveyed in accordance with the present invention.

DESCRIPTION OF THE PREFERRED EMBODIMENTS

The flue-gas end of the combustion chamber 1 of a pressurized fluidized bed communicates with a precipitator 2, a cyclone for example, in which flue dust is separated from the flue gas. Precipitator 2, which has another precipitator associated with it downstream, has a gas outlet 3 and a solids outlet 4 that communicte with a cooler 5. The cooler is a double-walled tubular cooler with an inner pipe 6 that accommodates the dust and is surrounded by a cooling jacket 7. Several parallel pipes combined into a package that accommodates the dust and is surrounded by a cooling jacket can also be employed instead of one pipe. Cooling jacket 7 is provided with an intake 8 and an outlet 9 for the coolant. The coolant can be compressed water or an organic coolant with a high boiling point. The coolant enters at 140° C.

The inner pipe 6 in cooler 5 communicates with a precipitator 10 that separates the dust from the flue gas. Separator 10 has a gas outlet 11 and a solids outlet 12. Gas outlet 11 accommodates flow controls 14 that act on a valve 13 to maintain the pressure. The solids outlet 12 from separator 10 communicates with a system of air locks that comprises a supply tank 15 and a lock tank 16. Precipitator 10 can also be integrated into supply tank 15.

Supply tank 15 and lock tank 16 communicate by way of a solids line 17 that is provided with a shutoff valve 18 and by way of a pressure-compensation line 19. Associated with supply tank 15 is a level sensor 20. A differential pressure gauge 21 is positioned in a test line between supply tank 15 and lock tank 16.

Lock tank 16 is equipped with a pressure line 22 that supplies compressed air to pressurize it and with an evacuation line 23 to depressurize it. There is a shutoff valve 24 in pressure line 22 and in evacuation line 23.

The air-lock system is activated when, once lock tank 16 has been depressurized, differential gauge 21 ceases to indicate a difference in pressure and level sensor 20 initiates the evacuation of supply tank 15 into lock tank 16.

The solids outlet of lock tank 16 communicates by way of a solids line 25 that can be blocked and unblocked with an injector 26 that is provided with a connection 27 for carrier air. Injector 26 commuicates with another cooler 28. The cooler is a double-walled tubular cooler with an inner pipe 29 that accommodates the dust and is surrounded by a cooling jacket 30. Several parallel pipes combined into a package that accommodates the dust and is surrounded by a cooling jacket can also be employed instead of one pipe. Cooling jacket 30 is provided with an intake 31 and an outlet 32 for the coolant. The coolant is water under low pressure and at a temperature of approximately 30° C.

The pipe 29 inside second cooler 28 opens into a silo 33 that is at atmospheric pressure. The silo is provided with a solids outlet 34 and with an exhaust-air line 35 that contains an exhaust filter 36. Evacuation line 23 also communicates with silo 33.

The flue gas that contains the dust leaves combustion chamber 1 when completely loaded at a temperature of approximately 850° C. and a pressure of approximately 16 bars. The precipitator 2 that separates the dust from the flue gas is operated in such a way that the gas will convey the dust through a conveyor section constituted by cooler 5. The volume of flue gas extracted along with the dust is controlled in such a way as to establish at the entrance into cooler 5 a speed of conveyance that will ensure pneumatic conveyance at the exit from the cooler as well. The coolant enters cooler 5 at a temperature of approximately 140° C. and leaves at a temperature of approximtely 160° C. The heat exchange inside inner pipe 6 is sufficient to cool the mixture to a temperature between 160° and 200° C., depending on the length and diameter of the pipe. This temperature is above the water and acid dew point of the particular flue gas. Little pressure is lost during the trip through the pipe 6 inside cooler 5, only 0 to 3 bars, depending on the volume of dust and on the length of the line. In the airlock system that consists of supply tank 15 and lock tank 16, the pressure of the dust is decreased to the level requisite for the air to convey it into silo 33. The pressure of the conveying air entering injector 26 is equal to or higher than that pressure. Depressurization to a level above atmospheric saves energy and time. Once the dust has traveled through second cooler 28, its pressure is decreased to atmospheric and its temperature to approximately 50° to 80° C. The dust can be removed at that temperature.

We claim:

1. A method of cooling flue dust precipitated from compressed flue gas from a fluidized bed of a combustion chamber comprising the steps of:

pneumatically conveying flue gas containing dust through at least one pipe to an air-lock system;

cooling said pipes externally so that the flue gas is at a temperature above the dew point of water and acid present in the flue gas;

separating said dust from said flue gas before entering said air-lock system;

removing said dust from said air lock system and conveying said dust by air therefrom; and cooling said dust to a final predetermined temperature by a coolant.

2. A method as defined in claim 1 and including the step of exposing the dust in said air-lock system to an air pressure above atmospheric pressure.

3. A method as defined in claim 1 wherein said cooling step is achieved with a coolant at a temperature above the dew points of the water and acid in said flue gas.

4. Apparatus is cooling and conveying flue dust comprising a combustion chamber having a fluidized bed for precipitating flue dust from compressed flue gas; first precipitator means; an air-lock system;

externally cooled first pipe means providing communication between said first precipitator means and said air-lock system; said air-lock system having an inlet and an outlet;

second precipitator means at said inlet into said air-lock system;

an injector having connection means for compressed air; externally cooled second pipe means communicating with said outlet of said air-lock system.

* * * * *